US008254819B2

(12) United States Patent
Okamoto

(10) Patent No.: US 8,254,819 B2
(45) Date of Patent: Aug. 28, 2012

(54) IMAGE HEATING APPARATUS

(75) Inventor: Osamu Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 12/827,123

(22) Filed: Jun. 30, 2010

(65) Prior Publication Data

US 2011/0008085 A1 Jan. 13, 2011

(30) Foreign Application Priority Data

Jul. 10, 2009 (JP) ..... 2009-163593

(51) Int. Cl.
*G03G 15/20* (2006.01)

(52) U.S. Cl. ..... 399/329; 399/324

(58) Field of Classification Search ..... 399/329, 399/324, 67, 122, 328
See application file for complete search history.

(56) References Cited

U.S. PATENT DOCUMENTS

| | | | |
|---|---|---|---|
| 7,392,006 | B2 | 6/2008 | Kameda et al. |
| 7,546,078 | B2 | 6/2009 | Okuda et al. |
| 2007/0059060 | A1 | 3/2007 | Kameda et al. |
| 2007/0059064 | A1 | 3/2007 | Okuda et al. |
| 2010/0316421 | A1* | 12/2010 | Komuro ..... 399/329 |

FOREIGN PATENT DOCUMENTS

| | | |
|---|---|---|
| CN | 1932684 A | 3/2007 |
| JP | 11-45018 | 2/1999 |
| JP | 2002-102763 | 4/2002 |
| JP | 2007-79067 | 3/2007 |

OTHER PUBLICATIONS

Chinese Office Action dated Sep. 15, 2011, in corresponding Chinese Application No. 201010229422.8, and English-language translation thereof.

* cited by examiner

*Primary Examiner* — Sophia S Chen
(74) *Attorney, Agent, or Firm* — Fitzpatrick, Cella, Harper & Scinto

(57) ABSTRACT

An image heating apparatus includes a rotatable member; a belt member, contactable to the rotatable member, for forming a nip in which an image on a recording material is heated; a pressing member, disposed inside the belt member, for pressing the belt member against the rotatable member; a lubricant application member for applying a lubricant onto an inner surface of the belt member; a contact-and-separation device for moving the belt member toward and away from the rotatable member; and a switching mechanism for switching a contact pressure of the lubricant application member on the belt member, when the belt member is separated from the rotatable member, so as to be smaller than that when the belt member contacts the rotatable member.

7 Claims, 9 Drawing Sheets

(a) URGED (b) SEPARATED

IMAGE HEATING APPARATUS

FIELD OF THE INVENTION AND RELATED ART

The present invention relates to an image heating apparatus, including a belt member which is supported by a plurality of supporting members and is rotatable, for heating an image on a recording material. Particularly, the present invention relates to the image hating apparatus including a lubricant application member for applying a lubricant in contact with a belt inner surface. The image heating apparatus can use the belt member e.g., a belt (type) fixing device (apparatus) for fixing or temporarily fixing an unfixed image carried on the recording material as a fixed image. Further, it is also possible to use a glossiness-increasing device for increasing the glossiness of the image fixed on the recording material by heat-pressing the image again.

The belt fixing device for fixing the unfixed toner image formed on the recording material (paper) will be described as an example.

In a constitution of the belt fixing device in which the inner surface of the belt member contacts the supporting members, which are non-rotatable members, it is desirable that the rotation load on the belt is decreased by lowering the friction resistance between the inner surface of the belt member and the supporting members, which are non-rotatable members. Japanese Laid-Open Patent Application (JP-A) Hei 11-045018 has proposed a constitution in which a lubricant application member (oil application member) for applying a lubricant (oil) in contact with the inner circumferential surface of the belt is provided so as to press-contact the belt inner circumferential surface. Further, it is desirable that a minimum necessary amount of oil applied from the oil application member is kept for the longest time. For this purpose, in JP-A 2002-102763 and JP-A 2007-79067 as the prior art, a roller using a porous sheet as a surface layer has been employed as the oil application member.

In the prior art, the oil application member is caused to always contact the belt inner surface. Therefore, when the belt is in a rotation state, the oil is supplied from the oil application member to the belt inner surface during not only a fixing operation of the fixing device but also a preparatory fixing operation. The oil to be supplied from the oil application member to the belt inner surface is required to be supplied in the minimum necessary amount and to be retained for a long time.

Particularly, in a contraction of the fixing device in which the belt and its opposing member for creating a nip therebetween are separated from each other in a period except during the fixing operation, the supply of the oil to the inner surface of the belt rotating during the preparatory fixing operation causes the excessive supply of oil, so that there arises a problem that the oil is liable to flow out of an end portion of the belt.

SUMMARY OF THE INVENTION

A principal object of the present invention is to provide an image heating apparatus capable of applying a lubricant onto an inner surface of a belt member corresponding to a change in an urged state (pressed state) of the belt member.

According to an aspect of the present invention, there is provided an image heating apparatus comprising:

a rotatable member;

a belt member, contactable to the rotatable member, for forming a nip in which an image on a recording material is heated;

a pressing member, disposed inside the belt member, for pressing the belt member against the rotatable member;

a lubricant application member for applying a lubricant onto an inner surface of the belt member;

contact-and-separation means for moving the belt member toward and away from the rotatable member; and a switching mechanism for switching the contact pressure of the lubricant application member on the belt member, when the belt member is separated from the rotatable member, so as to be smaller than that when the belt member contacts the rotatable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described more specifically based on embodiments. Incidentally, these embodiments are those to which the present invention is applicable but the present invention is not limited to these embodiments. The embodiments can be variously modified within the scope of the present invention.

(1) Image Forming Portion

Figure 4B:
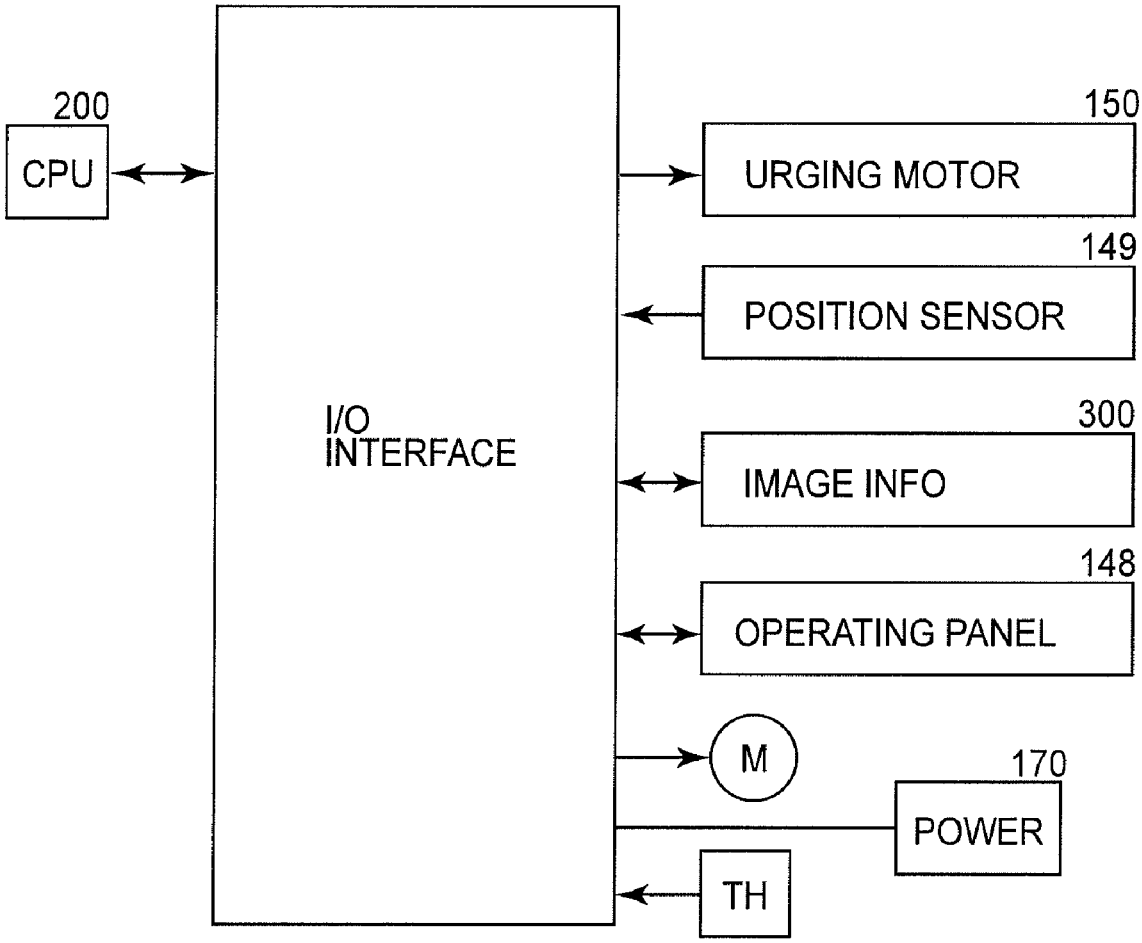
FIG. 4B is a block diagram of a control system.
Figure 5A:
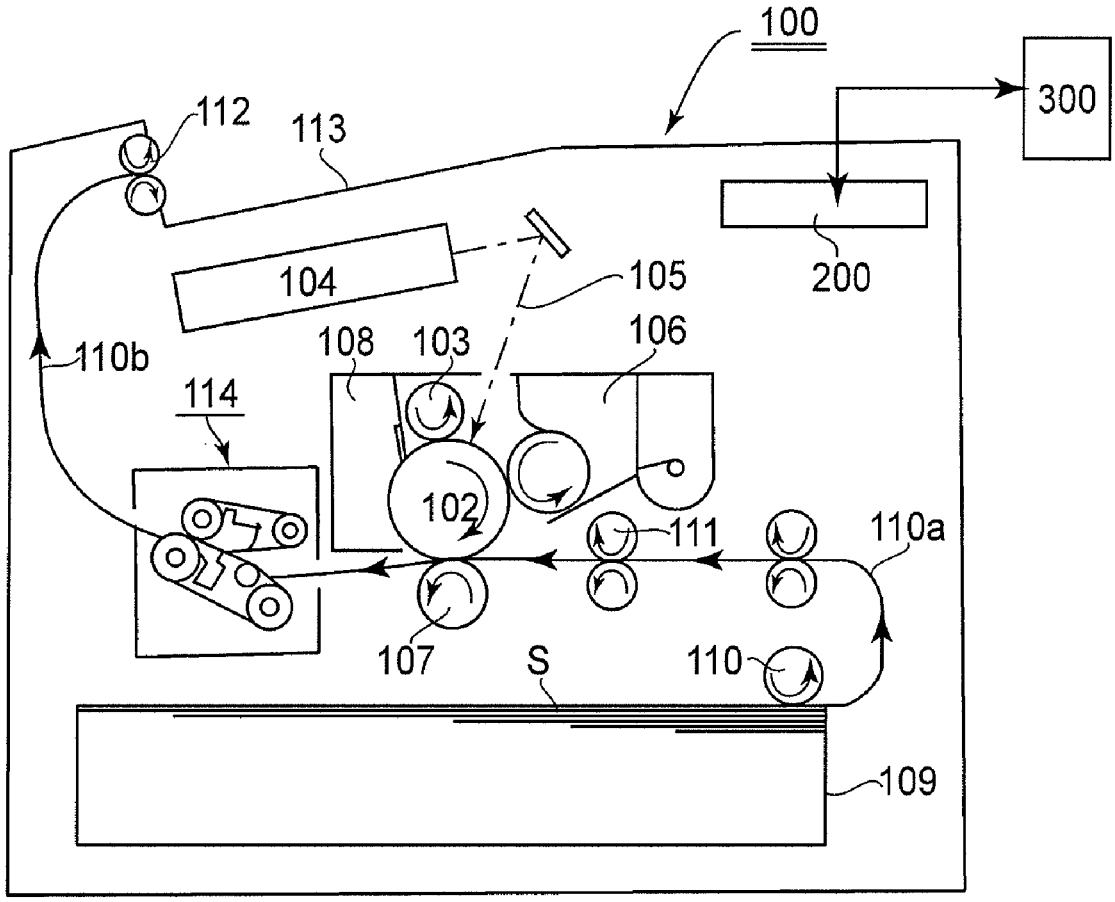
FIG. 5A is a schematic sectional view showing a schematic constitution of an image forming apparatus, as an example, in which an image processing device as a belt conveying device is mounted as the fixing device according to the present invention.

FIG. 5A is a schematic sectional view showing a schematic constitution of an image forming apparatus 100, as an example, in which an image heating apparatus as the belt conveying device in accordance with the present invention is mounted as a fixing device 114. This image forming apparatus 100 is a laser beam printer utilizing a transfer type electrophotographic process. The image forming apparatus 100 effects image formation on a sheet-like recording material (a recording medium, hereinafter referred to as a sheet) S on the basis of image information (electric image signal) input from a host device 300 into a controller portion (control means: CPU) 200. The host device 300 is a personal computer, an image reader, etc. The controller portion 200 transfers various pieces of electrical information between itself and the host device 300 or an operation panel 148 of the image forming apparatus 100 shown in FIG. 4B. Further, the controller portion 200 effects centralized control of an image forming operation of the image forming apparatus 100 in accordance with a predetermined control program or a predetermined reference table. The image forming apparatus 100 includes an electrophotographic photosensitive drum 102 as an image bearing member (hereinafter referred to as a drum). The drum 102 is rotationally driven at a predetermined speed in a clockwise direction and the drum surface is electrically charged uniformly to a predetermined polarity and a predetermined potential by a charger 103 as a charging means. The uniformly charged surface is subjected to scanning exposure to laser light (image light) 105 modulated depending on image information by a laser scanner (exposure device) 104 as an exposure means. As a result, an electrostatic latent image corresponding to the image information in the scanning exposure is formed on the surface of the drum 102. The electrostatic latent image is developed as a toner image by a developing device 106 as a developing means. The toner image is successively transferred onto the sheet S, guided to a transfer portion as a contact portion between the drum 102 and a transfer roller 107 as a transfer means, at the transfer portion. To the transfer roller 107, a transfer bias of an opposite polarity to a charge polarity of the toner is applied, so that the toner image is electrostatically transferred from the drum 102 onto the sheet S. The sheet S is stacked and accommodated in a sheet feeding cassette 109 located at a lower portion in the image forming apparatus. When a sheet feeding roller 110 is driven with predetermined sheet feeding timing, the sheet S in the cassette 109 is separated from other sheets S and the sheets S are fed one by one and pass through a conveying path 110*a* to reach a registration roller pair 111. The registration roller pair 111 receives a leading end of the sheet S and performs oblique movement correction of the sheet S. Further, the sheet S is conveyed to the transfer portion while being synchronized with the toner image on the drum 102 with a timing at which the leading end of the sheet S just reaches the transfer portion when a leading end of the toner image reaches the transfer portion. The sheet S passing through the transfer portion is separated from the surface of the drum 2 and is conveyed to the fixing device 114. By the fixing device 114, an unfixed toner image on the sheet S is fixed on the sheet surface as fixed image under the application of heat and pressure. Then, the sheet S passes through a conveying path 110*b* and is discharged and stacked on a discharging tray 113 located at an upper portion of the image forming apparatus by a discharging roller pair 112. Further, the surface of the drum 102 after the sheet separation is cleaned by removing residual deposited matter, such as transfer residual toner, by a cleaning device 108 as a cleaning means, thus being subjected to repetitive image formation.

Figure 5B:
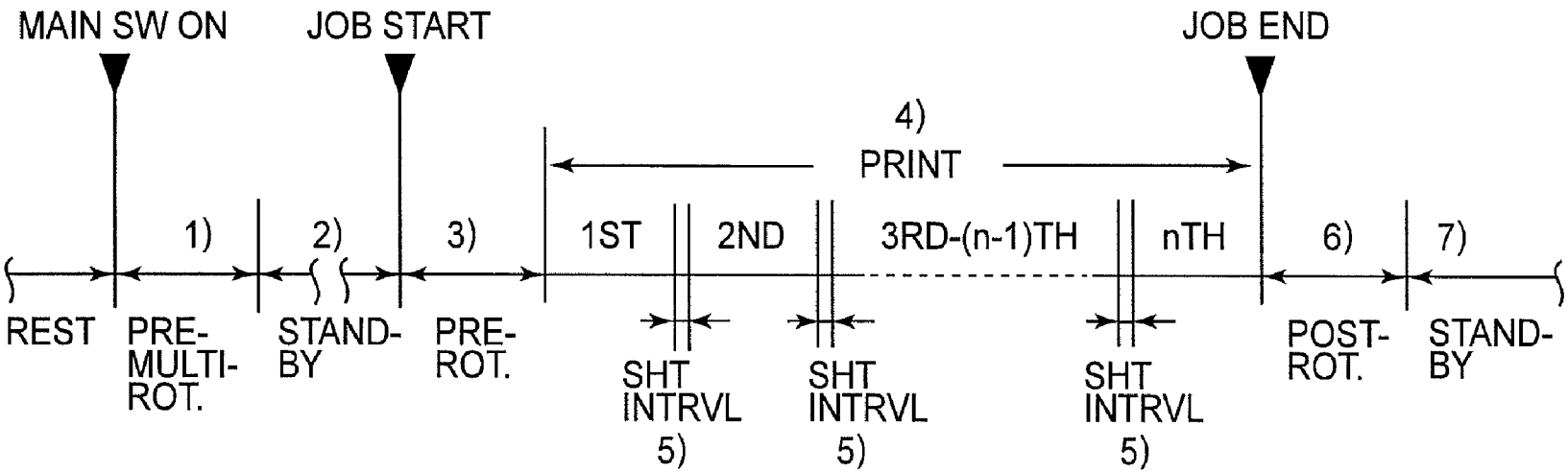
FIG. 5B is an operation process chart of the image forming apparatus.

FIG. 5B shows an operation process chart of the above-described image forming apparatus 100.

1) Pre-Multirotation Step

This step is performed in a predetermined start (actuation) operation period (warm-up period) of the image forming apparatus 100. In this step, a main power switch of the image forming apparatus is turned on to actuate a main motor (not shown) of the image forming apparatus, so that a preparatory rising operation of necessary process equipment is performed.

2) Standby

After the predetermined start operation period is ended, the drive of the main motor is stopped and the image forming apparatus is kept in a standby state until a print job start signal is input.

3) Pre-Rotation Step

In a period for a pre-rotation step, the main motor is driven again on the basis of the input of the print job start signal to perform a print job pre-operation of necessary process equipment.

In an actual operation, (a) the image forming apparatus receives the print job start signal, (b) an image is decompressed by a formatter (the decompression time varies depending on the amount of image data or the processing speed of the formatter, and then (c) the pre-rotation step is started.

Incidentally, in the case where the print job start signal is input during the pre-multirotation step 1), after the pre-multirotation step 1) is completed, the operation advances to this pre-rotation step 3) with no standby step 2).

4) Print Job Execution (Image Forming Step)

When the predetermined pre-rotation step is completed, the above-described image forming process is executed, so that a sheet S on which the image has been formed is output. In the case of a successive print job, the image forming process is repeated, so that a predetermined number of image-formed sheets S are output.

5) Sheet Interval Step

This step is a step of an interval between a trailing end of a sheet S and a leading end of a subsequent sheet S in the case of the successive print job. The period for this step corresponds to a non-sheet passing state period at the transfer portion or in the fixing device 114.

6) Post-Rotation Step

In the case of the print job for one sheet, in this period, the main motor is continuously driven after the image-formed sheet S is output (after the completion of the print job) to execute a print job post-operation of necessary process equipment. Alternatively, in the case of a successive print job, in this period, the main motor is continuously driven after a final image-formed sheet S is output (after the completion of the successive print job) to execute the print job post-operation of necessary process equipment.

7) Standby

After the predetermined post-rotation step is completed, the drive of the main motor is stopped and the image forming apparatus is kept in a standby state until a subsequent print job start signal is input.

(2) Fixing Device (Apparatus)

Figure 1A:
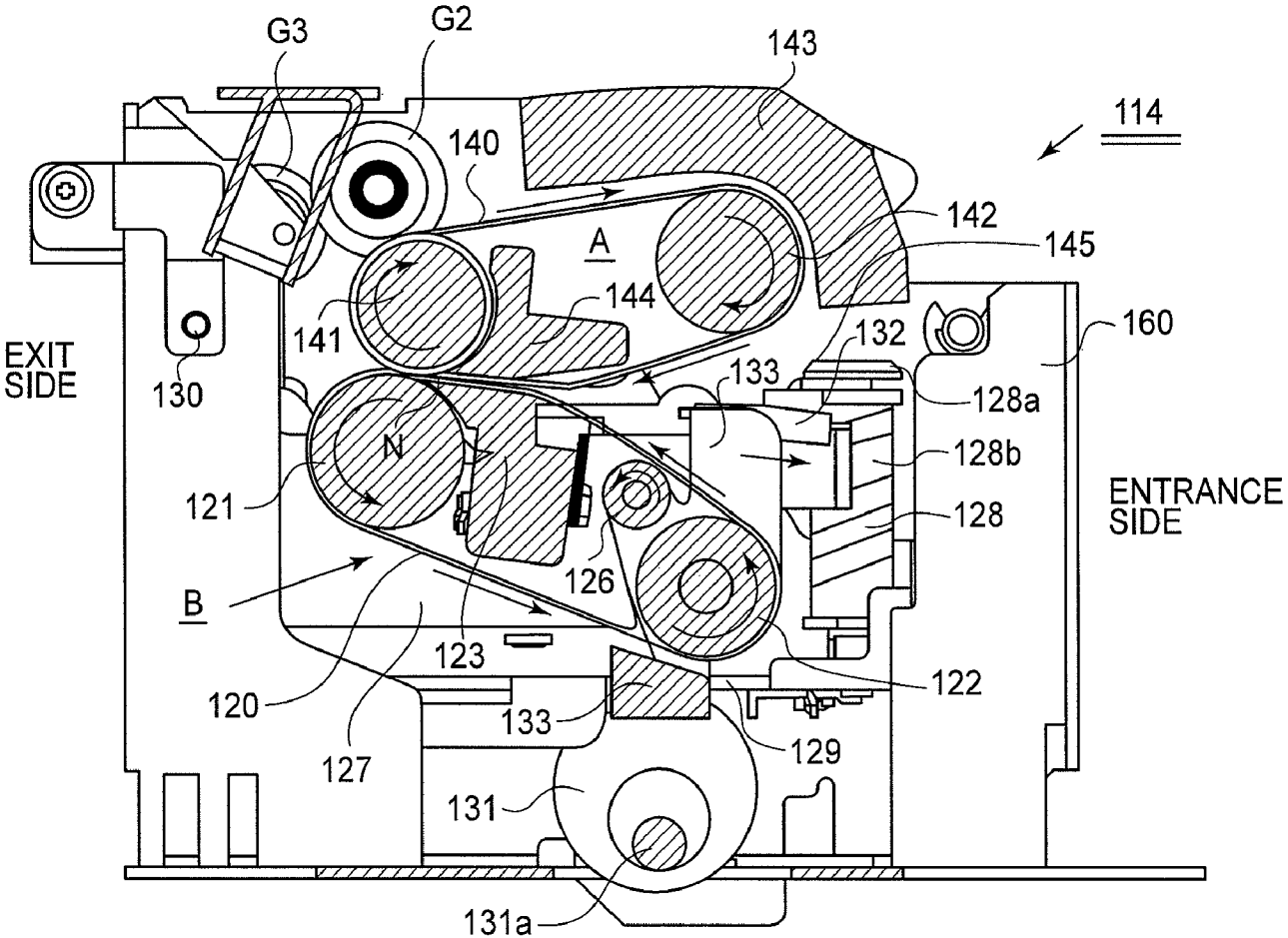
FIG. 1A is a schematic sectional view of a main part of a fixing device in an embodiment.
Figure 1B:
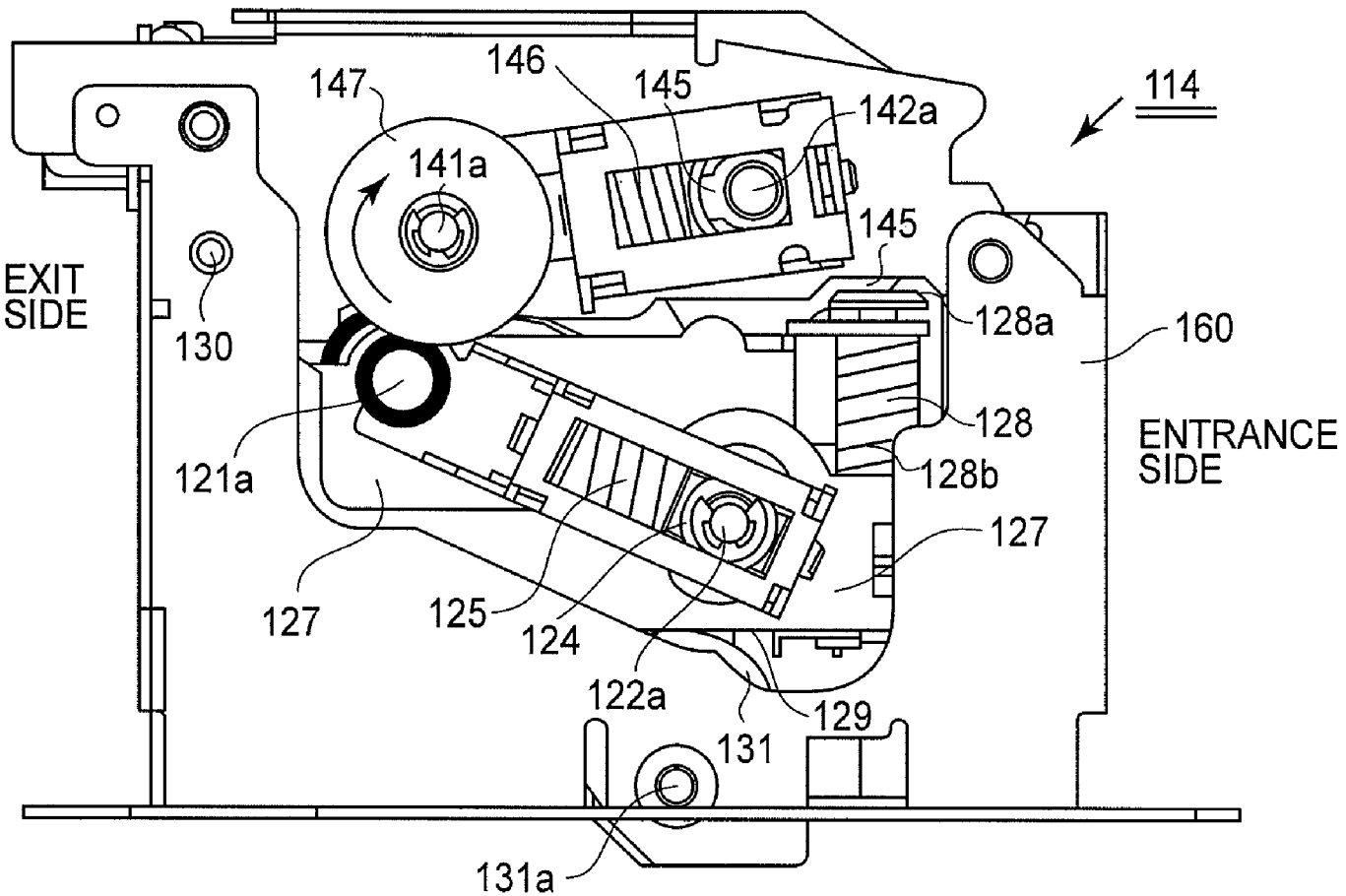
FIG. 1B is a left side view of the fixing device.

FIG. 1A is a schematic sectional view of a main part of the fixing device 114 in this embodiment, and FIG. 1B is a left side view of the fixing device 114. Here, with respect to the fixing device 114 and members constituting the fixing device 114, a longitudinal direction refers to a direction parallel to a direction perpendicular to a sheet conveyance direction in a sheet conveying path plane. A front surface of the fixing device 114 is a surface on a sheet introducing side. The terms "upper" and "lower" are described with respect to the direction of gravity. The terms "left" and "right" refer to the left and right directions when the fixing device 114 is viewed from its front surface side. A width of the belt means a belt dimension with respect to the direction perpendicular to the sheet conveyance direction (i.e., the dimension of the belt with respect to the longitudinal direction of the belt). Further, a width of the belt means a sheet dimension with respect to the direction perpendicular to the sheet conveyance direction on the sheet surface. Further, the terms "upstream" and "downstream" refer to those directions with respect to the sheet conveyance direction.

The fixing device 114 includes an upper side belt assembly A as a heating unit and a lower side belt assembly B as a pressing unit which are respectively disposed at upper and lower portions thereof between left and right side plates of a device frame 160. Further, the fixing device 114 includes a contact-and-separation mechanism for moving the upper side belt assembly B toward and away from the upper side belt assembly A. An upper side belt assembly A includes a heating belt 140 which is a belt member (endless belt) as a rotatable member and includes a driving roller 141, a tension roller 142 and a pad stay 144 which are a plurality of supporting members for supporting the belt 140. The belt 140 is extended around three members of the driving roller 141, the tension roller 142 and the pad stay 144 at a predetermined tension (e.g., 120 N) in a circulatory and rotatable manner. The upper side belt assembly A includes an induction heating coil unit 143 as a heat source for the heating belt 140. As the heating belt 140, an appropriate belt member may be selected so long as the belt member is induction-heated by the unit 143 and possesses heat resistivity. For example, a belt member prepared by coating a 300 μm-thick silicone rubber on a nickel (metal) layer having a thickness of 75 μm, a width of 380 mm and a circumferential (peripheral) length of 200 mm and then by coating a PFA tube as a support layer on the silicone rubber may be used. The driving roller 141 is formed by, e.g., integrally molding a solid stainless steel core metal having an outer diameter of 18 mm and a heat resistive silicone rubber elastic layer as a surface layer. The driving roller 141 is rotatably supported and disposed through bearings (not shown) at a predetermined position between the left and right side plates of the device frame 160 at left and right end portions of a roller shaft 141*a*. The tension roller 142 is, e.g., a hollow roller formed of stainless steel having an outer diameter of about 20 mm and an inner diameter of about 18 mm. The tension roller 142 is rotatably supported through bearings 145 between the left and right side plates of the device frame 160 at left and right end portions of a roller shaft 142*a*. The bearing 145 is movably urged toward a belt stretching direction by a tension spring 146. As a result, predetermined tension is applied to the belt 140. The pad stay 144 is a member formed of, e.g., stainless steel (SUS material) and is non-rotationally supported and disposed between the left and right side plates of the device frame 160. The driving roller 141 is located on a sheet exit side in the device frame 160. The tension roller 142 is located on a sheet entrance side in the device frame 160. The pad stay 144 is positioned inside the heating belt 140 and close to the driving roller 141 between the driving roller 141 and the tension roller 142, with a pad-receiving support downward. The unit 143 is supported and disposed at a predetermined position between the left and right side plates of the device frame 160 so as to oppose the belt 140 in a non-contact manner with a predetermined spacing over a range from an upper support portion of the belt 140 to the tension roller 142 portion of the belt 140. The driving roller 141 is provided with a drive gear 147 coaxially with the roller shaft 141*a*. To this gear 147, a driving force is input from a driving source M (FIG. 4B) through a drive transmission portion (not shown), so that the driving roller 141 is rotationally driven at a predetermined speed in the clockwise direction indicated by an arrow. By the rotation of the driving roller 141, the belt 140 is circulated and conveyed at a speed corresponding to the speed of the driving roller 141 in the clockwise direction indicated by an arrow. The tension roller 142 is rotated by the circulatory conveyance of the belt 140.

Figure 3:
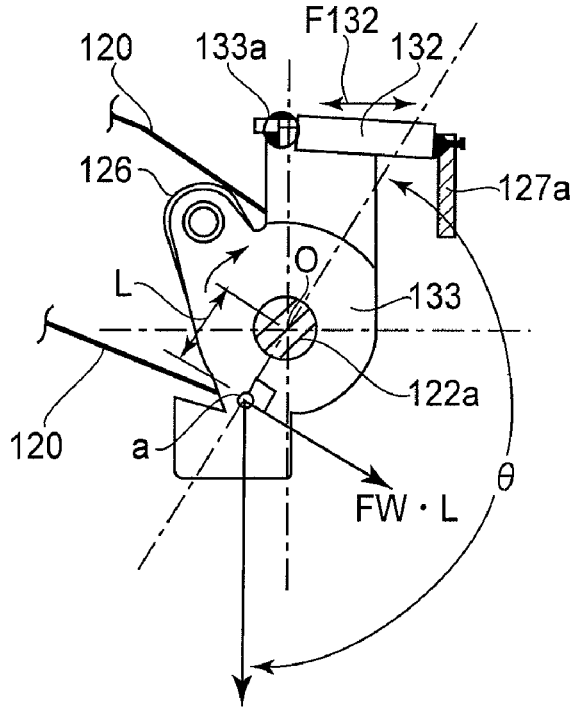
FIGS. 3(*a*) and 3(*b*) are schematic views each showing an operation state of an oil application supporting arm including an oil application roller with respect to a pressing belt, wherein FIG. 3(*a*) shows the urged state and FIG. 3(*b*) shows the separated state.
Figure 3:
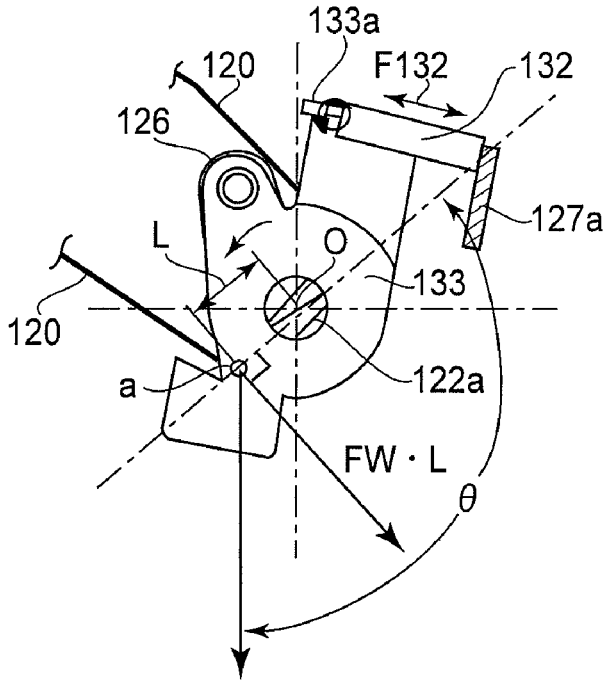

The lower side belt assembly B is swingably supported and disposed about a rotation center shaft 130 in a vertical direction between the left and right side plates the device frame 160 on a side below the upper side belt assembly A. The shaft 130 is located on the sheet exit side of the device frame 160. A lower side belt assembly B includes an urging arm (pressing arm) 127, a pressing belt 120 as the belt member and includes a pressing roller 121, a tension roller 122 and a pressing pad (pressing member) 123 which are a plurality of supporting members for supporting the belt 120. Further, the lower side B includes an oil application roller 126 as a lubricant application member for applying the lubricant onto the inner surface of the belt 120. The urging arm 127 is swingably supported about the above-described shaft 130 in the vertical direction. The pressing roller 121, the tension roller 122 and the pressing pad 123 are held by the urging arm 127. The belt 120 is extended around three members of the pressing roller 121, the tension roller 122 and the pressing pad 123 at a predetermined tension (e.g., 100 N) in a circulatory and rotatable manner. As the pressing belt 120, an appropriate belt member may be selected so long as the belt member possesses heat resistivity. For example, a belt member prepared by coating a 300 μm-thick silicone rubber on a nickel (metal) layer having a thickness of 50 μm, a width of 380 mm and a circumferential (peripheral) length of 200 mm and then by coating a PFA tube as a support layer on the silicone rubber may be used. The pressing roller 121 is formed to have an outer diameter of 20 mm. The pressing roller 121 is rotatably supported and disposed through bearings (not shown) between left and right side plates of the urging arm 127 at left and right end portions of a roller shaft 121*a*. The tension roller 122 is, e.g., a hollow roller formed of stainless steel having an outer diameter of about 20 mm and an inner diameter of about 18 mm. The tension roller 122 is rotatably supported through bearings 124 between the left and right side plates of the urging arm 127 at left and right end portions of a roller shaft 122*a*. Each bearing 124 is movably urged toward a belt stretching direction by a tension spring 125. As a result, predetermined tension is applied to the belt 120. The pressing pad 123 is a member formed of, e.g., a silicone rubber and is non-rotationally supported and disposed between the left and right side plates of the urging arm 127. The pressing roller 121 is located on a sheet exit side in the device frame 160. The tension roller 122 is located on a sheet entrance side in the device frame 160. The pressing pad 123 is disposed inside the pressing belt 120 and close to the pressing roller 121 between the pressing roller 121 and the tension roller 122, with a pad support upward. The oil application roller (lubricant application member) 126 is located image the belt 120 at a position between the pressing pad 123 and the tension roller 122. The oil application roller 126 is rotatably supported by a rotatable supporting arm 133. The supporting arm 133 is rotatably supported coaxially with the roller shaft 122*a* which is the rotation center of the tension roller 122. FIGS. 3(*a*) and 3(*b*) are enlarged views each showing the urging arm 133 portion. A stretching urging spring 132 is disposed between a spring hooking portion 133*a* of the supporting arm 133 and a spring hooking portion 127*a* of the urging arm 127. The supporting arm 133 is rotationally urged about the rotation center shaft 122*a* of the tension roller 122 in the clockwise direction indicated by an arrow in FIG. 3(*a*) by a stretching force of the spring 132. In an urged state (pressed state) shown in FIG. 3(*a*) described later, the oil application roller 126 press-contacts the inner surface of the belt 120. Inside the oil application roller 126 is a heat resistive aramid felt impregnated with heat resistive silicone oil having a viscosity of about 1000 CS as the lubricant for reducing friction on the belt inner surface.

On the heat resistive aramid felt, a sheet-like oil application control film consisting of a porous PTFE layer is formed as a surface layer. The oil application roller 126 contacts the inner surface of the belt 120 and supplies the silicone oil to the pressing belt inner surface while being rotated by the movement of the pressing belt 120.

Figure 2A:
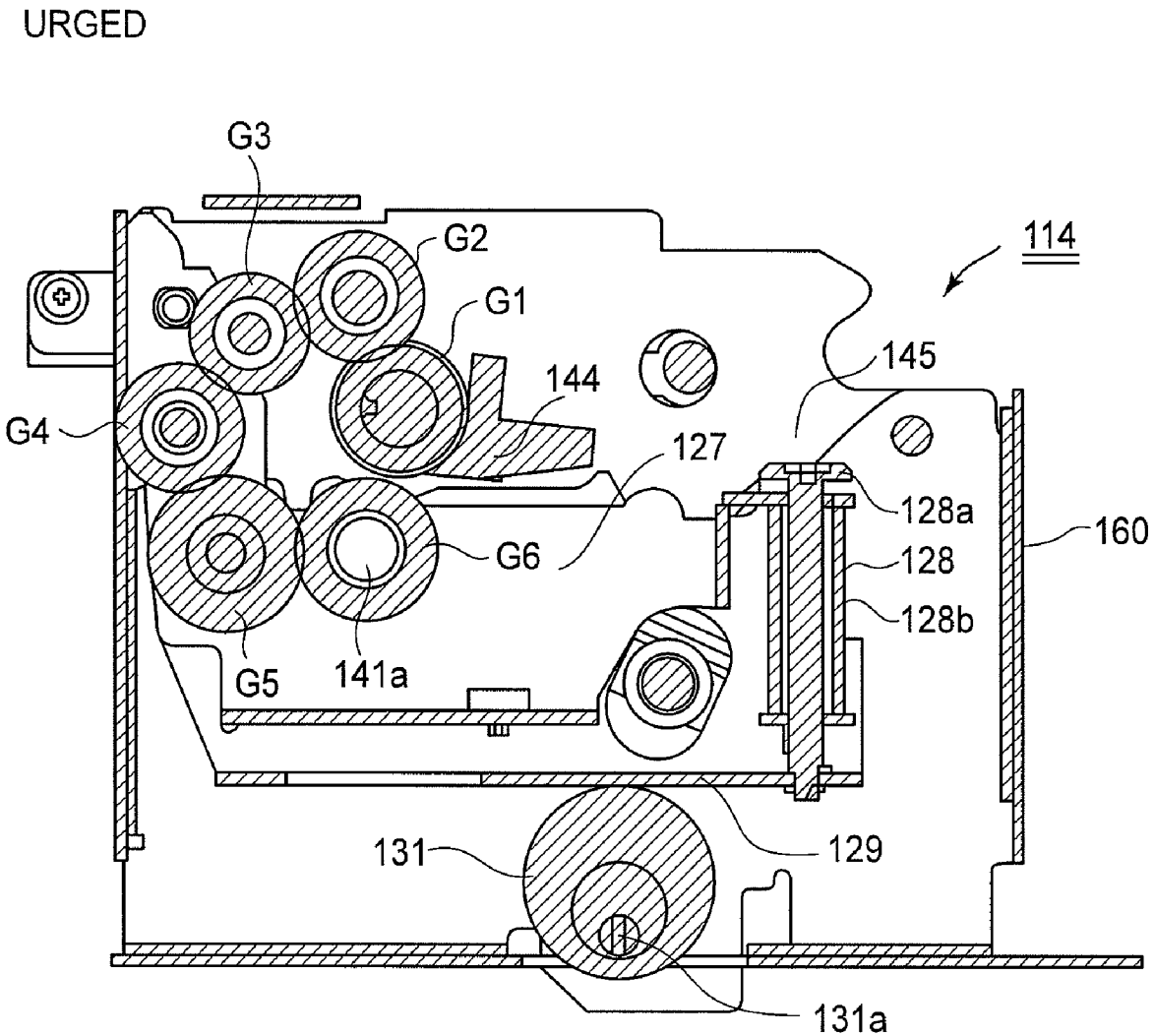
FIG. 2A is a schematic sectional view of the main part of the fixing device in an urged state (pressed state) in the embodiment.
Figure 2B:
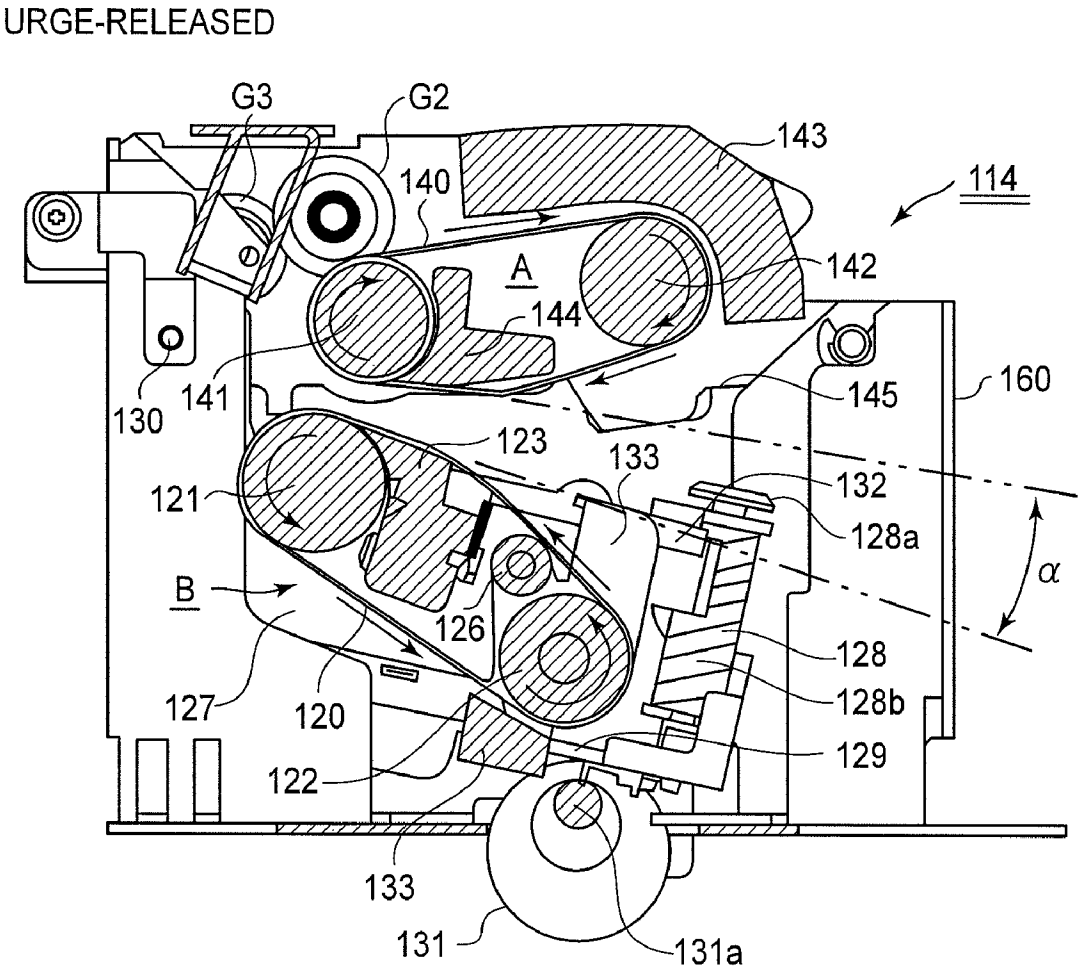
FIG. 2B is a schematic sectional view of the fixing device in an urge-released state (separated state).

A contact-and-separation means moves the lower side belt assembly B toward and away from the upper side belt assembly A. The urging arm 127 is provided with an urging spring unit 128 for causing the lower side belt assembly B to elastically press-contact the upper side belt assembly A on a side opposite from the rotation center shaft 130 side. The urging spring unit 128 contacts an urging rotation plate 129 on a side where the urging arm 127 opposes the urging rotation plate 129, so that the urging arm 127 and the urging rotation plate 129 are connected by the rotation center shaft 130. Thus, the urging rotation plate 129 is also vertically swingably supported about the shaft 130. The urging spring unit 128 is sandwiched between the urging arm 127 and the urging rotation plate 129 and is rotated about the rotation center shaft 130. An eccentric urging cam 131 contacts a lower surface of the urging rotation plate 129. The eccentric urging cam 131 is a member for switching the state of the lower side belt assembly B relative to the upper side belt assembly A between an urged state and a separated state by vertically swinging the urging arm 127, i.e., the lower side belt assembly B. The urging cam 131 is shaft-supported by the device frame 160 at a shaft portion 131*a* and is rotated by rotating the shaft portion 131*a* by an urging motor 150 (FIG. 4B) controlled by a controller portion 200. Further, in the fixing device, an urging position detecting sensor 149 (FIG. 4B) is provided and detects the position of the urging cam 131, so that the positions of the lower side belt assembly B relative to the upper side belt assembly A for contact and separation therebetween can be accurately determined. The urging cam 131 has a maximum (arcuate) projection and a minimum (arcuate) projection located 180 degrees opposite from the maximum projection. FIG. 2B shows a state of an angle of rotation of the urging cam 131 in which the minimum projection is directed upward and the maximum projection is directed downward. In this state, the lower side belt assembly B is rotated downward about the shaft 130 by gravitation to be located at a maximum lower position where the lower side belt assembly B is supported by the minimum projection of the urging cam 131. At the lower position, the lower side belt assembly B is separated (spaced) from the upper side belt assembly A to release the nip created between the upper side belt assembly A and itself. This device state is referred to as an urge-released state. In this urge-released state, when the controller portion 200 turns on the urging motor 150 to rotate the urging cam 131, the lower side belt assembly B is pushed up by the urging cam 131 and is rotated upward about the shaft 130. Then, in the course of 180-degree rotation of the urging cam 131, an upper end portion 128*a* of the urging spring unit 128 abuts against and is received by a stationary receiving portion 145 provided on the upper side belt assembly A side. Then, the lower side belt assembly B is rotated upward by further rotation of the urging cam 131 while compressing an urging spring 128*b* of the urging spring unit 128, so that the pressing roller 121 presses the pressing belt 120 against the heating belt 140 toward the driving roller 141. Further, the pressing pad 123 presses the pressing belt 120 against the heating belt 140 toward the pad stay 144. The controller portion 200 turns off the urging motor 150 at the time when the urging position detecting sensor 149 detects that the urging cam 131 is rotated 180 degrees to provide such an angle of rotation that the maximum projection is directed upward. In this state, by compression reaction force of the urging spring 128*b*, the pressing roller 121 of the lower side belt assembly B presses the pressing belt 120 against the heating belt 140 toward the driving roller 141 at a predetermined pressure to create the nip between the pressing belt 120 and the heating belt 140. The elastic layer of the driving roller 141 is elastically deformed by a predetermined amount by the press-contact of the pressing belt 120 with the heating belt 140. Further, the pressing pad 123 of the lower side belt assembly B presses the pressing belt 120 against the heating belt 140 toward the pad stay 144 of the upper side belt assembly A at a predetermined pressure (e.g., 400 N) to create the nip together with the pressing roller 121. That is, the heating belt 140 and the pressing belt 120 press-contact each other to create a wide nip (fixing nip) N with respect to the sheet conveyance direction. This device state is referred to as the urged state. FIG. 1A and FIG. 2A show the urged state. Here, the heating belt 140 is an opposing member for creating the nip by the press-contact with the pressing belt 120. Further, the pressing pad 123 is a pressing member, which is disposed inside the pressing belt 120, for creating the nip by pressing the pressing belt 120 against the heating belt 140. The urging spring unit 128 is fixed on the urging rotation plate 129. The urging arm 127 is urged upward by the urging spring unit 128 and in this state, is located at a position in which the urging arm 127 abuts against the upper end portion 128*a* of the urging spring unit 128. By the rotation of the urging rotation plate 129, the urging spring unit 128 and the urging arm 127 are also rotated, so that the urging spring unit 128 is located at a position in which the urging spring unit 128 is urged against the upper side belt assembly A. The urging spring unit 128 follows the position of the urging rotation plate 129, so that the urging spring 128*b* is compressed.

In the above-described urged state by rotating 180 degrees the urging cam 131, the device state is switched to the above-described urge-released state again. That is, by subjecting the urging cam 131 to 180-degree rotation control, the device state is alternately switched between the urged state and the urge-released state. In this embodiment, between the urged state and the urge-released state, the lower side belt assembly B is rotated about the shaft 130 relative to the upper side belt assembly A by 10 degrees (swing angle $\alpha$). In both of the urged state and the urge-released state, the pressing belt 120 and the like constituting the lower side belt assembly B are integrally rotated. For that reason, a relative position among the pressing belt 120, the pressing roller 121, the tension roller 122, the pressing pad 123 and the oil application roller 126 is not changed except by an amount corresponding to elastic deformation of the rubber of the pressing pad 123. For that reason, even in the urge-released state, the pressing pad 123 contacts the pressing belt 120. In the urged state, the drive (driving force) is input from a driving source M (FIG. 4B) to a driving roller gear 147 of the upper side belt assembly A through a drive transmission means (not shown), so that the driving roller 141 is rotationally driven at a predetermined speed in the clockwise direction indicated by the arrow. By this rotation of the driving roller 141, the heating belt 140 is circulated and conveyed at a speed corresponding to the speed of the driving roller 141 in the clockwise direction indicated by the arrow. The tension roller 142 is rotated by the circulatory conveyance of the belt 140. Further, a rotational force of the driving roller 141 is transmitted to the pressing roller 121 of the lower side belt assembly B through a driving gear train including gears G1 to G6 (FIG. 2A), so that the pressing roller 21 is rotationally driven in the counterclockwise direction indicated by the arrow. By this rotation of the pressing roller 121, the pressing belt 120 is circulated and conveyed in the counterclockwise direction indicated by the arrow. The tension roller 122 is rotated by the circulatory conveyance of the pressing belt 120. However, in the case where the pressing belt 120 is pressed against the heating belt 140 with a sufficient nip pressure, the pressing belt 120 follows the heating belt 140, so that the pressing roller 121 slides on the inner surface of the pressing belt 120. In this embodiment, the pressing belt 120 and the heating belt 140 are rotated at a peripheral speed equal to a sheet S-conveying speed of 210 mm/sec. Further, to the induction heating coil unit 143, a high-frequency current is supplied from a power portion 170 (FIG. 4B). As a result, the heating belt 140 is induction-heated. The controller portion 200 controls power to be supplied from the power portion 170 to the coil unit 143 so that temperature information input from a temperature sensor TH (FIG. 4B) for detecting a temperature of the heating belt 140 is kept at temperature information corresponding to a predetermined fixing temperature. In this embodiment, the temperature of the heating belt 140 is controlled at the fixing temperature of 180° C. The temperature of the pressing belt 120 is about 100° C. In this state, the recording material (sheet) S on which the toner image is formed is introduced into the fixing device 114 from the image forming portion. The recording material S enters the nip between the heating belt 140 and the pressing belt 120 and is nipped and conveyed in the nip (inserted through the nip), so that the unfixed toner image on the recording material is fixed under the application of heat and pressure (image-processed) as a fixed image. In this embodiment, during the preparatory operation of the image forming apparatus or during stand-by, the fixing device is controlled so as to be placed in the urge-released state. Further, also in the urge-released state, the heating belt 140 and the pressing belt 120 are rotated and the heating belt 140 is heated. That is, also in the urge-released state, the drive is input to the driving roller gear 147 to rotate the heating belt 140. Further, the rotational force of the driving roller 141 is transmitted to the pressing roller 121 through the gears G1 to G6 of the driving gear train, thus rotating the pressing belt 120. Further, the power is supplied to the induction heating coil unit 143, so that the heating belt 140 is heated. This is because the temperature of the heating belt 140 can be kept at the controlled temperature and the temperatures of both the belts 140 and 120 with respect to the circumferential direction can be uniformly maintained.

Figure 4A:
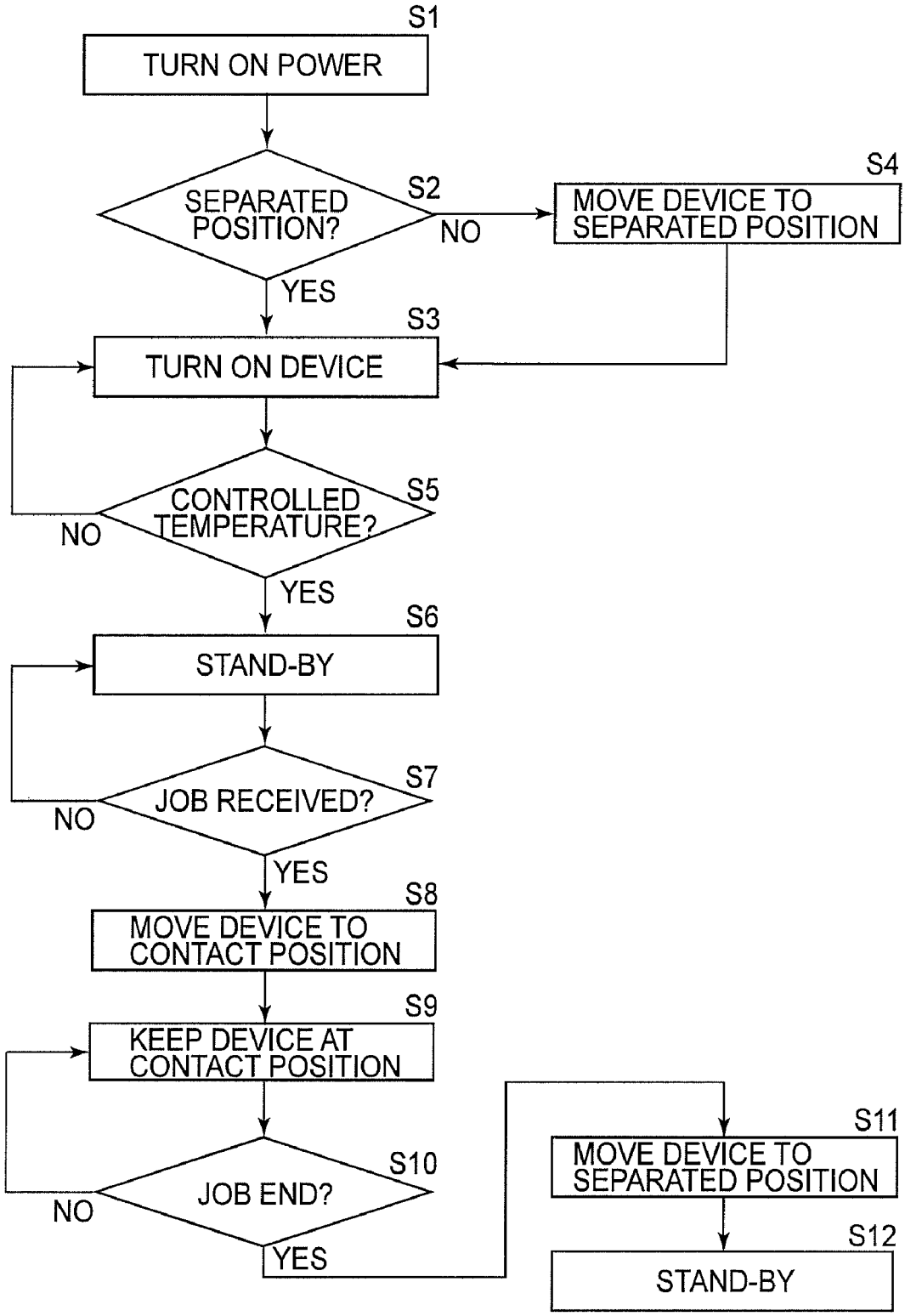
FIG. 4A is a flow chart of movement operation control of the fixing device for pressure application and separation.

FIG. 4A is a flow chart of movement operation control of the fixing device 114 for pressure application and separation, and FIG. 4B is a block diagram of a control system. When the power of the image forming apparatus is turned on (S1), the procedure goes into the pre-multirotation step in which the preparatory rising operation of the image forming apparatus is performed. The fixing device 114 performs, in the urge-released state (at the separated position for fixation), the rotational drive of the belts 140 and 120 and causes a rise in temperature of the heating belt 140 (S2 to S5). When the pre-multirotation step is completed, the image forming apparatus is held in the stand-by state until a print job start signal is input (S6 and S7). Also in this stand-by state, the fixing device 114 is in the urge-released state, and the rotational drive of the belts 140 and 120 and the heating of the heating belt 140 are performed. When the print job start signal is input, the control procedure in the image forming apparatus goes into the pre-rotation step. The device state of the fixing device 114 is switched into the urged state (press-contact position for fixation) by receipt of the print job (start signal) by the image forming apparatus as a trigger (S8). Then, the print job is performed. The urged state of the fixing device 114 is kept until the print job is completed and the fixing device 114 executes a fixing process (image processing) with respect to the recording material S (S9 and S10). That is, into the nip, the recording material S on which the unfixed toner image is carried is inserted, so that the fixing process of the recording material S is performed. When the print job is completed, the control procedure in the image forming apparatus goes into the post-rotation step. The device state of the fixing device 114 is switched into the urge-released state after the completion of the print job, i.e., after the final sheet of the print job is discharged out of the image forming apparatus (S11). Also in this post-rotation step, the fixing device 114 is in the urge-released state, and the rotational drive of the belts 140 and 120 and the heating of the heating belt 140 are performed. When the post-rotation step is completed, the image forming apparatus is placed in the stand-by state (S12). Also in this stand-by state, the fixing device 114 is in the urge-released state, and the rotational drive of the belts 140 and 120 and the heating of the heating belt 140 are performed. The heating belt 140 and the pressing belt 120 are always in the above-described separated state (urge-released state) during the preparatory operation of the image forming apparatus or during the stand-by and are always rotated. This is because the temperature of the heating belt 140 can be kept at the controlled temperature and the temperatures of both the belts with respect to the circumferential direction can be uniformly kept. As described above, with respect to the nip, the device state is placed in the urged state during the device operation and the urge-released state in which the nip is removed (eliminated). Here, it is also possible to employ a constitution in which the rotational speed of the belts 140 and 120 in the fixing device in the urge-released state and the controlled temperature of the belt 140 are different from those during the operation of the fixing device 114 in the urged state.

(3) Lubricant Application Member

An operation of the oil application supporting arm 133 including the oil application roller 126 as the lubricant application member in the urged state and separated state (urge-released state) of the fixing device 114 will be described with reference to FIGS. 3(*a*) and 3(*b*). The oil application roller 126 is supported by the rotatable supporting arm 133. Then, by the contact-and-separation operation of the lower side belt assembly B relative to the upper side belt assembly A by the contact-and-separation means described above, an angle θ formed between a gravitational direction W and a rectilinear line connecting a rotation center O of the supporting arm 133 and a center a of gravity of the supporting arm 133 is changed (FIGS. 3(*a*) and 3(*b*)). As a result, the supporting arm 133 is rotationally moved so that the contact pressure of the oil application roller 126 with the belt 120 is changed. In this embodiment, the angle θ during the separation (FIG. 3(*b*)) is smaller than that during the pressure-application (FIG. 3(*a*)).

FIGS. 3(*a*) and 3(*b*) show operation states of the oil application supporting arm 133, including the oil application roller 126, relative to the pressing belt 120 with respect to the urged state and the separated state (urge-released state), respectively, in the fixing device 114. In this embodiment, the oil application roller 126 has a weight of 50 g and the oil application supporting arm 133 has a weight of 370 g, so that a total weight (gravitation) W is 420 g. In FIGS. 3(*a*) and 3(*b*), a point a represents the position of the center of gravity when the oil application roller 126 and the oil application supporting arm 133 are integrally supported. This position a of the center of gravity is spaced from the shaft position O (the arm rotation center) of the roller shaft 122*a* of the tension roller 122 which is the rotation center of the supporting arm 133. L represents a spacing distance. Therefore, on the supporting arm 133, the weight moment FW×L with the shaft position O as a supporting point and the position a of the center of gravity as a point of application is exerted. In this embodiment, the rotational movement direction (rotational direction) of the supporting arm 133 by the moment FW×L is a position in which the oil application roller 126 is separated from the pressing belt 120. Further, between the spring hooking portion 133*a* of the supporting arm 133 and the spring hooking portion 127*a* of the urging arm 127, the tension urging spring (oil application urging spring) 132 is provided. This oil application urging spring 132 rotationally-urges the supporting arm 133 toward a direction opposite to the rotational movement direction by the moment FW×L, i.e., rotationally-urges the oil application roller 126 toward the inner surface side of the pressing belt 120. In this embodiment, a spring force of the urging spring 132 is 75 gf. Based on the above-described relationship, in the urged state of the fixing device 114 shown in FIG. 3(*a*) in this embodiment, a spring force F132 is set at a value larger than the moment FW×L. As a result, in the urged state of the fixing device 114, the oil application roller 126 is kept in a state in which the oil application roller 126 contacts the inner surface of the pressing belt 120 at a predetermined urging force. That is, in the urged state of the fixing device 114, the oil application roller 126 is urged against the pressing belt 120 by the spring force of the urging spring 132.

On the other hand, in the separated state of the fixing device 114 shown in FIG. 3(*b*), the pressing belt 120 and the like constituting the lower side belt assembly B are integrally separated from the upper side belt assembly A as described above. Therefore, the relative position among the pressing belt 120, the tension roller 122, the oil application roller 126, the oil application supporting arm 133 and the oil application urging spring 132 in the separated lower side belt assembly B is not changed from that in the urged state. By 10-degree rotation of the lower side belt assembly B from the urged state to the separated state, the moment FW×L about the arm rotation center based on the total weight W of the weights of the oil application roller 126 and the oil application supporting arm 133 is increased. On the other hand, the spring force F132 of the urging spring 132 is constant. For that reason, the force is increased with respect to the direction in which the oil application roller 126 is separated (spaced) from the inner surface of the pressing belt 120, with the result that a contact force of the oil application roller 126 with the inner surface of the pressing belt 120 in the separated state of the fixing device 114 is made smaller than that in the urged state of the fixing device 114. Alternatively, the oil application roller 126 is held at the position in which the oil application roller 126 is separated from the inner surface of the pressing belt 120. In this case, the contact force of the oil application roller 126 with the inner surface of the pressing belt 120 becomes zero. That is, the device state of the fixing device 114 is switched from the urged state to the separated state to change an attitude of the oil application supporting arm 133 with respect to the gravitational direction, so that the moment FW×L in the separated state is larger than that in the urged state. As a result, the contact force of the oil application roller 126 with the pressing belt 120 in the urged state is larger than that in the separated state. This switching of the contact force of the oil application roller 126 with the pressing belt 120 between the urged state and the separated state is performed by only the change in position (state) between the urged state and the separated state of the fixing device 114. That is, the oil supply amount is changed by only the positional change between the contact and the separation depending on the press-contact state of the devices in the nip during the fixing device operation and the separated state (nip-removed state) during the preparatory operation or during the stand-by. Here, it can be considered that the friction (abrasion) resistance originally intended to be lowered in increased in the case where the oil supply amount is decreased or the oil supply is stopped when the nip is removed. However, when the nip is removed, the contact pressure between the belt inner surface and the pressing pad 123 which is the non-rotational member is also lowered, so that the problem of the increase in friction resistance is less liable to occur. On the other hand, when the device state of the fixing device 114 is switched from the separated state to the urged state, the spring force F132 is larger than the moment FW×L, the state of the oil application roller 126 is returned to the state in which the oil application roller 126 contacts the inner surface of the pressing belt 120 at the predetermined urging force.

In summary, the oil application roller 126 is supported by the rotatable supporting arm 133. Then, by the contact-and-separation operation of the lower side belt assembly B relative to the upper side belt assembly A by the contact-and-separation means described above, an angle θ formed between a gravitational direction W and a rectilinear line connecting a rotation center O of the supporting arm 133 and a center a of gravity of the supporting arm 133 is changed (FIGS. 3(*a*) and 3(*b*)). As a result, the supporting arm 133 is rotationally moved so that the contact pressure of the oil application roller 126 with the belt 120 is changed. In this embodiment, the angle θ during the separation (FIG. 3(*b*)) is smaller than that during the pressure-application (FIG. 3(*a*)). By the above-described constitution, by the belt rotation during the preparatory operation and stand-by of the fixing device, the oil is supplied only during the operation without being supplied from the oil application roller to the belt inner surface. As a result, it becomes possible to supply the oil so as to always stabilize a lubrication state inside the belt while efficiently utilizing the limited amount of the oil with which the inside of the oil application roller is impregnated. The oil supply amount can be decreased by lowering the urging force exerted from the oil application roller on the belt inner surface in the same constitution without sufficiently spacing the oil application roller from the belt inner surface, so that a similar effect can be obtained. Thus, by an inexpensive and simple constitution, the application amount of the lubricant inside the belt during the preparatory operation is made smaller than that during the operation of the fixing device. As a result, the lubricant can be supplied so as to always stabilize the lubrication state inside the belt while efficiently utilizing the limited amount of the oil with which the inside of the lubricant application member is impregnated.

In the fixing device 114 in the above-described embodiment, the upper side belt assembly A may also be a heating roller. That is, the opposing member for creating the nip in contact with the pressing belt 120 may be the heating roller. On the other hand, the lower side belt assembly B opposing the upper side belt assembly A may also be the pressing roller. That is, the opposing member for creating the nip in contact with the heating belt 140 may be the pressing roller. In this case, in the upper side belt assembly A, the lubricant application member for decreasing the friction resistance between the heating belt 140 and the non-rotatable member is disposed, and the upper side belt assembly A is constituted so as to be vertically swingable. By an inexpensive and simple constitution, the application amount of the lubricant inside the belt during the preparatory operation is made smaller than that during the operation of the fixing device. As a result, the lubricant can be supplied so as to always stabilize the lubrication state inside the belt while efficiently utilizing the limited amount of the oil with which the inside of the lubricant application member is impregnated.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 163593/2009 filed Jul. 10, 2009, which is hereby incorporated by reference.

What is claimed is:

1. An image heating apparatus comprising:

a rotatable member;

a rotatable belt member, contactable to said rotatable member, configured to form a nip in which an image on a recording material is heated with said rotatable member;

a pressing member, disposed inside said belt member, configured to press said belt member against said rotatable member;

a lubricant application member configured to apply a lubricant onto an inner surface of said belt member;

a contact-and-separation device configured to move said belt member toward and away from said rotatable member; and a switching mechanism configured to switch the contact pressure of said lubricant application member on said belt member, so that when said belt member is separated from said rotatable member and rotates in contact with said pressing member, said lubricant application member contacts said belt member with a smaller contact pressure than that when said belt member rotates in contact with said rotatable member and said pressing member.

2. An apparatus according to claim 1, wherein said switching mechanism includes a rotatable supporting arm configured to support said lubricant application member and switches the contact pressure by changing an angle formed between a gravitational direction and a rectilinear line connecting a rotation center of the supporting arm and the center of gravity of the supporting arm by a contact-and-separation operation of said belt member by said contact-and-separation device.

3. An apparatus according to claim 2, wherein said switching mechanism includes a stretching member configured to stretch said belt member, where the supporting arm is supported by the stretching member, and wherein said switching mechanism switches the contact pressure by changing a position of the stretching member.

4. An apparatus according to claim 1, wherein said belt member is separated from said rotatable member in a stand-by state in which said image heating apparatus is ready for an image heating operation.

5. An apparatus according to claim 4, wherein when said belt member is separated from said rotatable member, said pressing member contacts said belt member.

6. An apparatus according to claim 1, wherein said switching mechanism performs a switching operation of the contact pressure in interrelation with an operation of said contact-and-separation device.

7. An image heating apparatus comprising:

rotatable means for rotating;

rotatable belt means, contactable to said rotatable means, for forming a nip in which an image on a recording material is heated with said rotatable means;

pressing means, disposed inside said belt means, for pressing said belt means against said rotatable means;

lubricant application means for applying a lubricant onto an inner surface of said belt means;

contact-and-separation means for moving said belt means toward and away from said rotatable means; and switching means for switching the contact pressure of said lubricant application means on said belt means, so that when said belt means is separated from said rotatable means and rotates in contact with said pressing means, said lubricant application means contacts said belt means with a smaller contact pressure than that when said belt means rotates in contact with said rotatable means and said pressing means.

* * * * *